US005091199A

United States Patent [19]

Mally et al.

[11] Patent Number: 5,091,199

[45] Date of Patent: Feb. 25, 1992

[54] UNITARY COMPARTMENTED PACKAGE AND METHOD OF MAKING SAME

[75] Inventors: Timothy G. Mally, Oregon; Bjorn J. Thompson, Madison, both of Wis.

[73] Assignee: Oscar Mayer Foods Corporation, Madison, Wis.

[21] Appl. No.: 538,794

[22] Filed: Jun. 15, 1990

[51] Int. Cl.[5] ..... B65D 85/00

[52] U.S. Cl. ..... 426/120; 53/433; 206/485; 426/124; 426/396; 426/398; 426/410

[58] Field of Search ..... 426/120, 410, 392, 396, 426/399, 122, 124, 115, 119; 206/266, 256, 257, 258, 538, 528, 633, 631.1, 631, 485; 53/453, 433, 485

[56] References Cited

U.S. PATENT DOCUMENTS

| | | | |
|---|---|---|---|
| 2,958,168 | 11/1960 | Vogt | 53/453 |
| 2,983,424 | 5/1961 | Glass | 206/256 |
| 3,281,051 | 10/1966 | O'Brien et al. | 426/122 |
| 3,292,810 | 12/1966 | Schechter | 426/119 |
| 3,414,414 | 12/1968 | Christine et al. | 426/119 |
| 4,013,798 | 3/1977 | Goltsos | 426/107 |
| 4,159,771 | 7/1979 | Komatsu et al. | 206/620 |
| 4,355,755 | 10/1982 | Faller | 229/2.5 R |
| 4,831,811 | 5/1989 | Nixon, Jr. et al. | 53/433 |

*Primary Examiner*—Donald E. Czaja
*Assistant Examiner*—Anthony Weier
*Attorney, Agent, or Firm*—Lockwood, Alex, Fitzgibbon & Cummings

[57] ABSTRACT

A unitary multi-compartment package includes a package body member which partially encloses a formed product tray having multiple product compartments. The product tray is attached to the package body member and the multiple product compartments depend downwardly therethrough through one or more openings. Package flap panels are folded around and underneath the product tray to partially enclose the product compartments between opposing package panels. A cover film is attached to the product tray to seal individual distinct product portions in multiple product compartments.

31 Claims, 4 Drawing Sheets

UNITARY COMPARTMENTED PACKAGE AND METHOD OF MAKING SAME

The present invention generally relates to a multi-component package for food products. More particularly, the present invention relates to a package having multiple compartments intended for different products which are packaged in a single unit.

There are many instances where it is desirable to package two or more different component products together and sell them as a unit. Often, in instances where the component products are food products, the freshness or perception of freshness of such products may be affected in some manner if the two component products are in contact with one another at any time. Thus, it is often desirable to package two or more components in the same package unit but in isolation from each other.

As an example, preassembled lunch or snack packages which are composed of sliced meat, diced cheese, stacked crackers and/or dessert pudding can be packaged in this manner. The flavor, texture and perceived freshness of these products may be affected if they are exposed to or allowed to contact one another during the time of package filling. In addition, changeovers from one type of meat to another during the assembly of such packages would require a wet sanitation which would seriously reduce production and greatly affect the freshness of components such as crackers.

In the assembly of such multiple compartment packages it is desirable to form, fill and seal such packages in a single assembly line. Where such an assembly can be done on a single web in a continuous process, rather than an intermittent process requiring transfer to different work stations, manufacturing costs are saved and higher production speeds are more easily attained. In such a continuous process, it is desirable to laminate a flexible, formable film to a precut paperboard stock to allow the package inner product tray to be formed directly on the assembly line, rather than off-line, thereby eliminating the need for providing space near the production line for an inventory of product trays.

There have been some attempts to produce multi-compartment packages. For example, U.S. Pat. No. 4,159,771 describes a container having multiple, individual and independently openable product compartments. The individual product compartments are formed and filled in a separate product tray. This product tray is later inserted into a partially formed paperboard carton which is then further assembled over the product to form a sealed carton enclosing the same. This process requires that the product compartment be formed and filled at a separate station and then conveyed to the outer carton assembly station. As such, it is labor intensive, and the production speed thereof is limited by the efficiency at which the separate product trays are filled and conveyed to the carton assembly station.

On the other hand, U.S. Pat. No. 4,355,755 describes a food tray suitable for packaging as individual food units into a final package wherein the tray is formed by drawing a paperboard blank into a tray shape having individual product compartments. Although the tray can be formed and filled in-line, the filled product must be separately packaged.

The present invention successfully addresses the aforementioned disadvantages and provides significant advantages in that it provides an outer paperboard package component having a plurality of package panels, at least one of which serves as a support for a multiple compartment product tray formed from a flexible film which is attached to the paperboard package component. During assembly, the multiple product compartments are formed in place on a package support panel section of a paperboard blank, and the remaining package panel section of the blank are folded around the formed product tray such that the product tray is held in place between two opposing package panels. A covering film which is applied to the product tray and its paperboard support is sealed thereto to provide a hermetic seal disposed around each of the multiple product compartments. Preferably, the package has an easy-open or "peel" seal portion which can maintain a vacuum pressurized and/or gas-flushed environment within the package while permitting at least a portion of the covering film to be separated from the rest of the package by the application of digital forces.

One or more package end panels effectively enclose the product tray within the folded and assembled package blank to thereby provide an assembled package having a "boxed" and somewhat rigid shape which is particularly well-suited for automated packing of individual package units into larger shipping boxes.

Accordingly, it is a general object of the present invention to provide an improved unitary package having multiple, individually sealed product compartments.

Another object of the present invention is to provide a multi-ply package blank capable of forming a unitary, multiple product compartment package containing a product tray held between two opposing package panels, wherein the blank includes a bottom package-forming web and a top product tray-forming web, the top web including a formable film adhered to a package support panel and covering an opening therein, the top film being capable of forming a product tray. The bottom web has a pair of package flap panels which extend away from the product tray support panel to enclose the product tray therebetween.

It is yet a further object of the present invention to provide a package which is adapted to hold a product tray having multiple compartments and wherein the multiple product compartments are adapted to contain quantities of different food products such as sliced meat products, dairy products and cracker products.

Yet another object of the present invention is to provide a package having a product tray with separate product compartments wherein the product tray is adhered to and supported by a package face panel.

Still another object of the present invention is to provide a process for manufacturing a multiple product compartment package having a product tray formed in an outer package wrapper.

These and other objects of the present invention will become more readily apparent from a reading of the following detailed description.

DETAILED DESCRIPTION OF THE PREFERRED EMBODIMENTS

Figure 1:
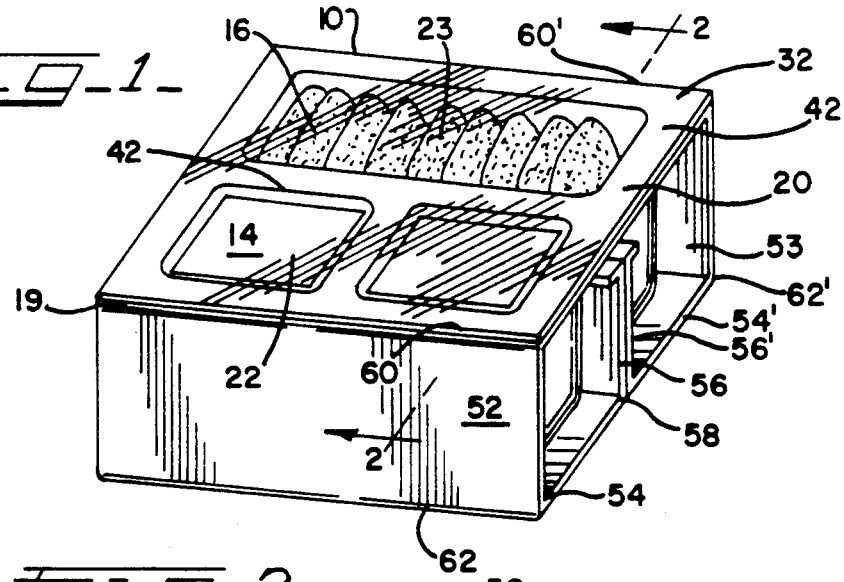
FIG. 1 is a perspective view of a package incorporating the principles of the present invention.

FIG. 1 illustrates an embodiment of a unitary multiple compartment package 10 constructed in accordance with the principles of the present invention. The package 10 is particularly suitable for sealing multiple distinct portions of perishable meat, dairy and cracker products, such as bologna slices 12, cheese slices 14 and crackers 16, between a one-piece product tray 20 and a covering film sheet 40. The package 10 includes three main components: the semi-rigid product tray 20, a package outer body member 30 and a package cover 40.

Figure 4:
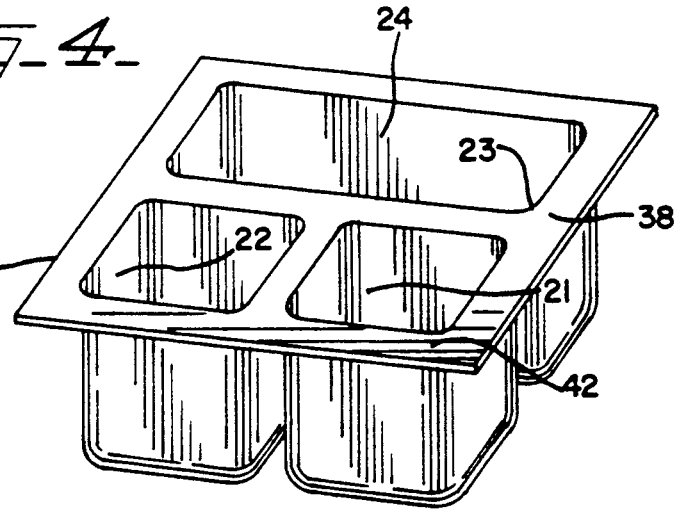
FIG. 4 is a perspective view of the product tray of the package of FIG. 1 with the package portion removed for clarity.

As shown in detail in FIG. 4, the product tray 20, which is easily vacuum formed in a conventional manner from a formable plastic film such as Barex® or polyethylene terephthalate (PET) contains three separate hollow receptacles or product compartments 21, 22, 23 which are interconnected to each other by an integral and connective inner rim 24. The inner rim 24 is interconnected to each product receptacle 21, 22, 23 at the top of the downwardly depending sidewalls thereof 24, 25, 26. Each product compartment typically is illustrated as generally rectangular in shape, however, it will be understood that other shapes, such as circular shapes can accommodate the various food products intended for depositing therein. The product compartments each have a sufficient number of vertical and bottom sidewalls to form a receptacle or product compartment having a desired depth to accommodate a preselected amount of food product(s). The connective rim 24 is sufficiently wide to form an inner flange 27 extending between the multiple product compartments which flange 27 provides the product tray 20 with an underside surface which can be securely attached to the package body member 30 as will be explained in greater detail below. Additionally, the top surface of the inner flange 27 provides a surface surrounding the product compartments 21, 22, 23 to which the flexible cover film 40 is attached which seals the food products 12, 14, 16 in the package product tray 20.

The product tray 20 also includes an outer rim 28 extending around the perimeter of the product tray 20 which rim 28 also has a width generally similar to that of the inner rim 27. The outer rim 28 also provides the product tray 20 with an outer flange 35 which can be securely adhered to both the body member 30 on its underside and to which the cover film 40 can be adhered to on its upper side.

The first flexible film 19 which forms the product tray 20 can be made from a variety of materials including plastic films, multi-layered laminated films and/or co-extruded films and the like. A preferred plastic film for assembly of the product trays of the packages of the present invention is one which is substantially impervious to air, oxygen and/or moisture. As is known in the art, multi-layered films comprised of Saran and nylon; Saran and polypropylene, ethylene vinyl alcohol (EVOH) and nylon, and ethylene vinyl alcohol and polyethylene terephthalate (PET) are suitable.

Figure 2:
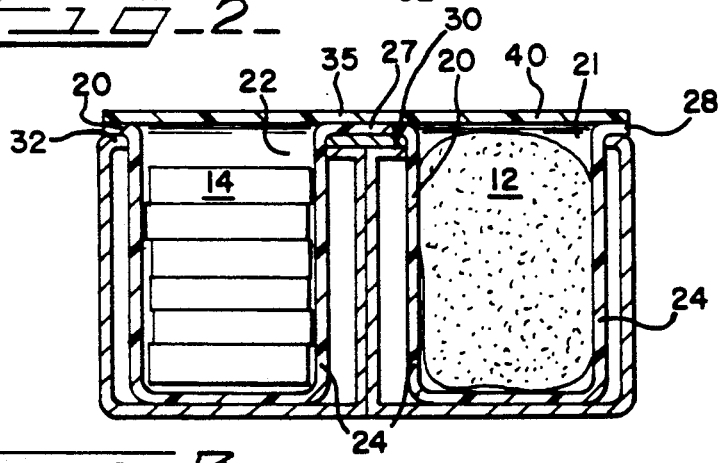
FIG. 2 is a cross-sectional view of the package of FIG. 1, taken along line 2—2.
Figure 3:
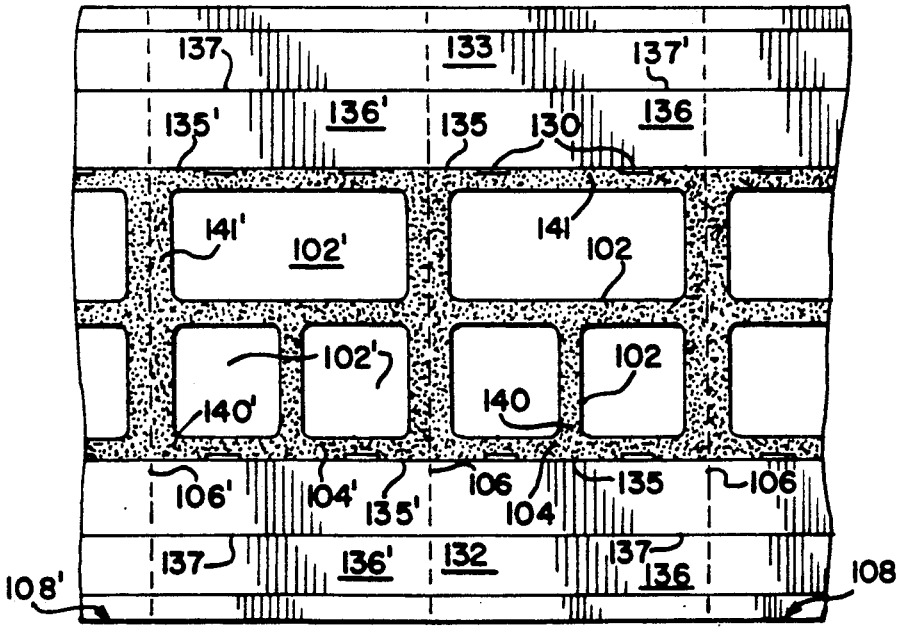
FIG. 3 is a plan view of a continuous stock of package blanks from which the package of FIG. 1 is formed.
Figure 9:
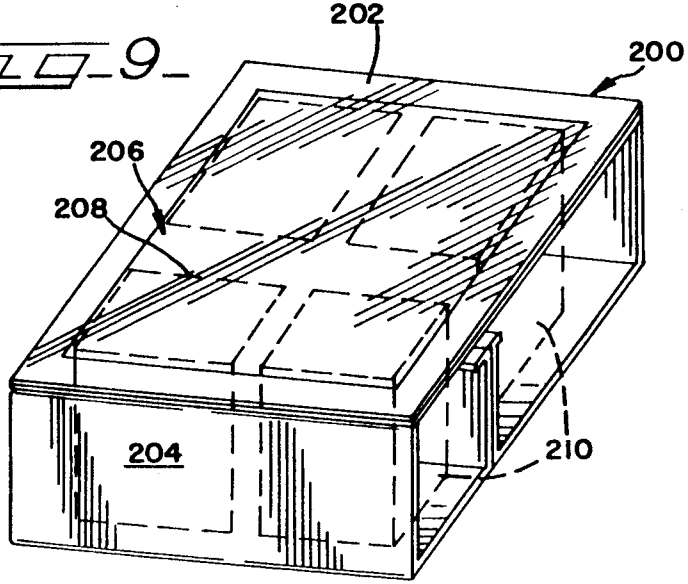
FIG. 9 is a perspective view of a second embodiment of a package constructed in accordance with the principles of the present invention.
Figure 7:
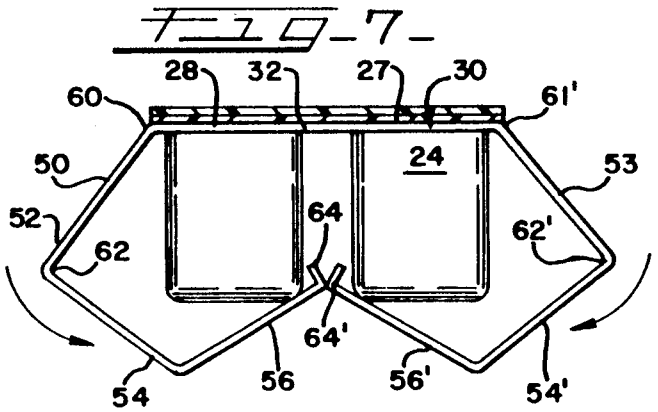
FIG. 7 is an elevational view illustrating assembly of the panels of the package blank to form the package of FIG. 1.
Figure 10:
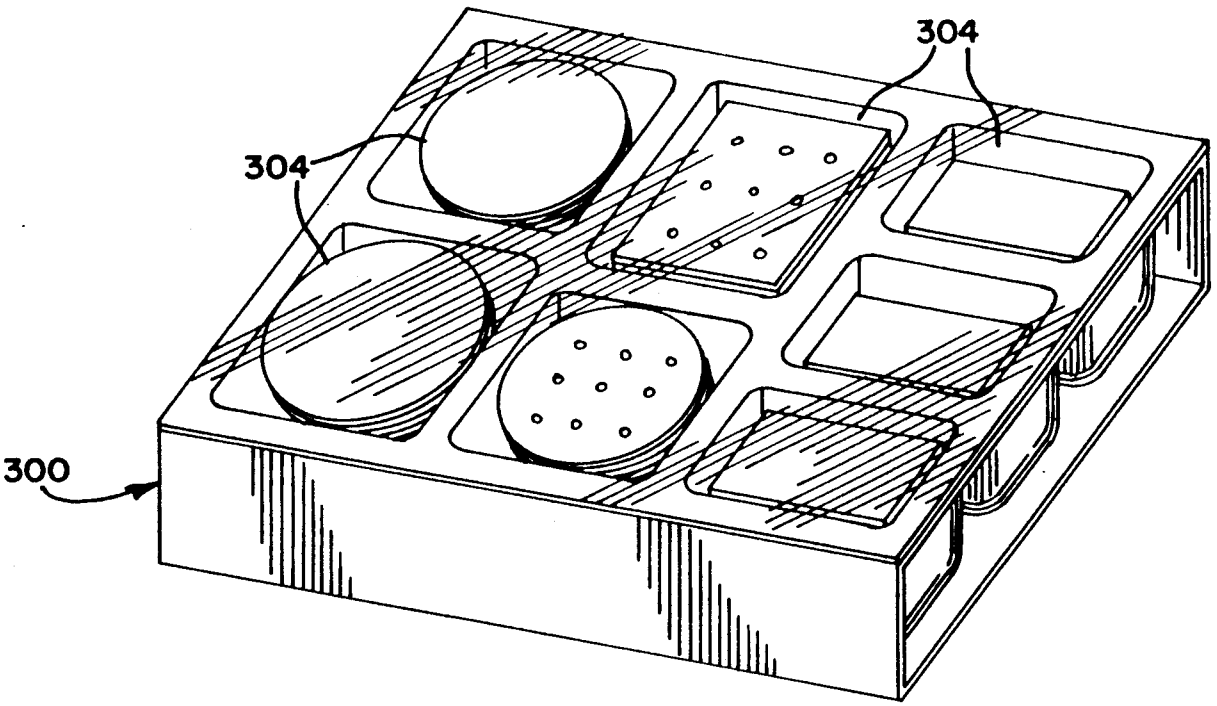
FIG. 10 is a perspective view of a third embodiment of a package constructed in accordance with the principles of the present invention.

Referring specifically to FIGS. 2 and 7, the product tray 20 is secured in place in the package 10 by contact with a face panel 32 of a package body member 30. The package face panel 32 may have any preselected number of openings 34 which correspond in location and number to the multiple product compartments 21–23 of the product tray 20 so as to facilitate assembly of the package 10. Three such openings 34 are shown in the FIG. 1 embodiment and seven 304 are shown in the FIG. 10 embodiment 300. Alternatively, as is shown in the package embodiment 200 illustrated in FIG. 9, the face panel 202 of the package body member 204 may just have a single, generally rectangular opening 206 which is adapted to receive the product tray 208 and its associated multiple product compartments 210 therein.

The product tray 20 of the package 10 is preferably adhered to the inner and outer 27, 28 rims of the package face panel 32 by any suitable conventional means, such as a layer of adhesive 38 disposed in a pattern on the face panel rims 27, 28 surrounding the multiple openings 24 and the product tray 20. The product tray 20, can also be attached to the face panel 30 by heat sealing or ultrasonic welding prior to forming of the product compartments 21–23. A covering film 40, is placed on top of the product tray 20 after the food products have been deposited therein and is attached to the top surfaces of the inner and outer connective rims 27, 28 thereof to provide a hermetic peelable seal 42 surrounding each distinct product portion 12–16 and extending around the perimeter of the product tray 20. It is preferable that the package hermetic seal 42 is a secure, yet peelable hermetic seal which maintains a secure seal during handling and storage that can be peeled back upon the application of digital forces applied to either the ends or corners of the covering film sheet 19.

As can be readily seen from the Figures, the product tray 20 is partially enclosed between two opposing panels of the package body member 30, shown as the top package face panel 32 and the package bottom panel 58. The package body member 30 is preferably made from a paperboard or cardboard stock of a sufficient thickness to withstand the various steps of the package assembly process. Additionally, the body member 30 should have a surface which accepts printing inks and the desired adhesive means of attachment between the product tray 20 and itself. The body member 30 may include an extended package flap panel which extends away from the face panel portion 32 thereof and which is folded around the product tray compartments 21–23 to partially enclose them between two opposing panels of the package 10, a pair of flap panels 52, 32 as shown in FIGS. 1 and 7 which extend away from opposing sides of the package face panel 32.

To assemble the body member 30 in its product tray enclosing configuration, the flap panels 52, 53 are folded downwardly along a first fold line 60, 60′ disposed generally parallel to and proximate to opposing edges of the product tray 20 to define a pair of package side panels. The flap panels 52, 53 may be further folded along a pair of second fold lines 62, 62', disposed exterior of and generally parallel to the first fold lines to define a pair of package bottom panel halves 54, 54' and a pair of package sealing panels 56, 56'. The package sealing panels 56, 56' are attached together at confronting faces thereof and may also include a pair of additional sealing extension flanges 64, 64' at the ends.

The body member 30 final configuration is accomplished by either attaching the package sealing panels 56, 56' to each other or, in addition thereto, the additional extension flanges 64, 64' may be further attached to the underside of one of the inner rims 27 of the package face panel 32 as illustrated in FIG. 2. Inasmuch as the package flap panels extend away from the package face panel 32 on two sides thereof the product tray 20 is partially enclosed between the package face panel 32 and the bottom panels 54, 54'.

The cover film 40, which is adhered to the product tray inner and outer rims 27, 28 may be preprinted with suitable package graphics. The present invention provides certain advantages in that any desired number of product compartments may be formed in the product tray 20. In this regard, only the eventual package body member with need be increased.

The production of packages of the present invention is shown in FIGS. 3 and 5 through 8. A continuous strip 100 of the package body member blanks which are preprinted and prepunched to provide the desired number of openings 102, 102' in the face panel portion 104, 104' thereof (FIG. 3) is advanced from a supply roll 150. The continuous feed strip 100 may include a series equally spaced transverse lines of weakening 106, 106' which define adjacent individual package blanks 108, 108' arranged in succeeding order. A length of formable film 110 is advanced off of a supply roll 160 or the like and deposited onto the package face panels 104, 104' of successive package blanks 108, 108'. The formable film 110 is suitably attached to the package blanks 108, 108', either by attaching the film 110 over the openings 102, 102' in each blank 108, 108' in preselected lengths terminating at or shortly interior of the transverse lines of separation 106, or by attaching the film 110 as a continuous length across adjoining successive package face panels 104, 104' to form a series of continuous, interconnected package film assemblies. The film 110 may be attached to the package face panels 104, 104' by laminating, adhesively sealing or heat sealing it to the inner and outer rims 140, 141 of the face panels 104, 104'. The film 110 is preferably dimensioned to match the transverse dimensions of the package face panels so that there is no wasting of the first film material during the production process.

Figure 5:
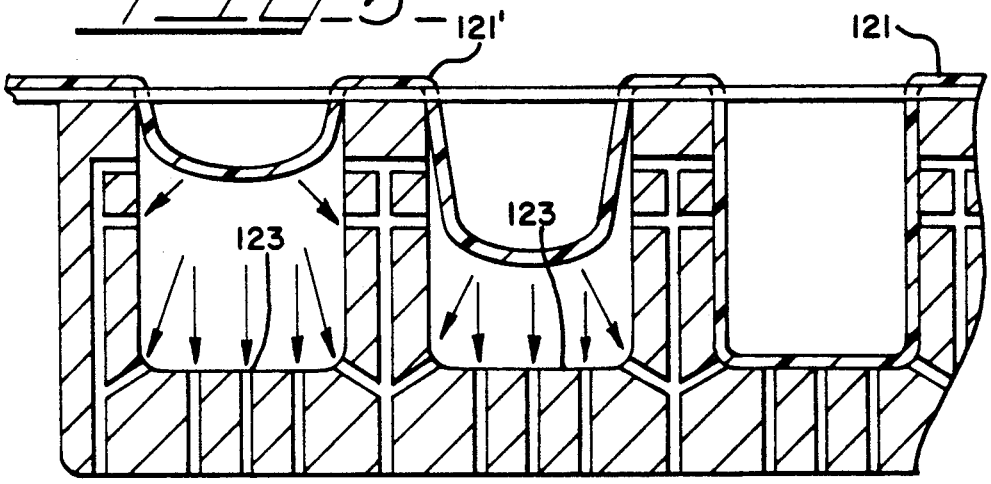
FIG. 5 is a fragmentary sectional view of a die assembly forming the product tray of the package of FIG. 1.
Figure 6:
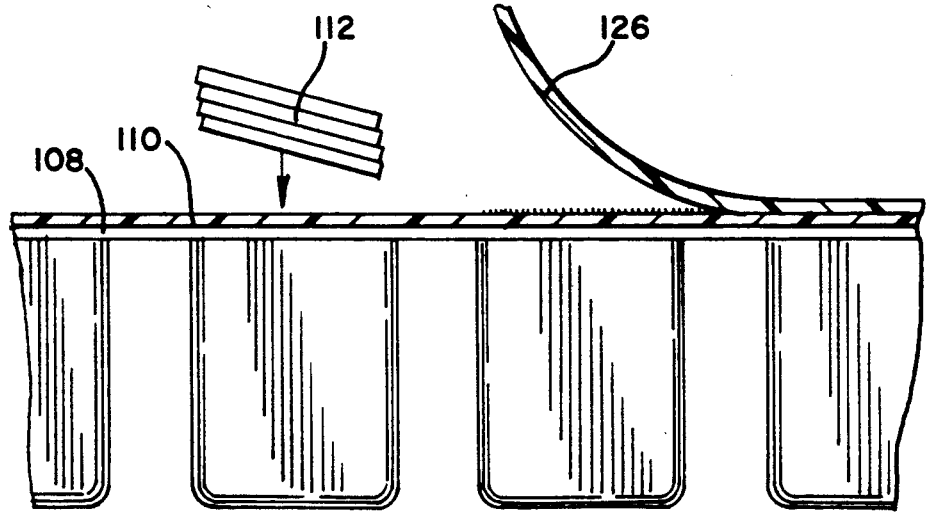
FIG. 6 is an elevational view showing filling and sealing of the packages of the present invention.
Figure 8:
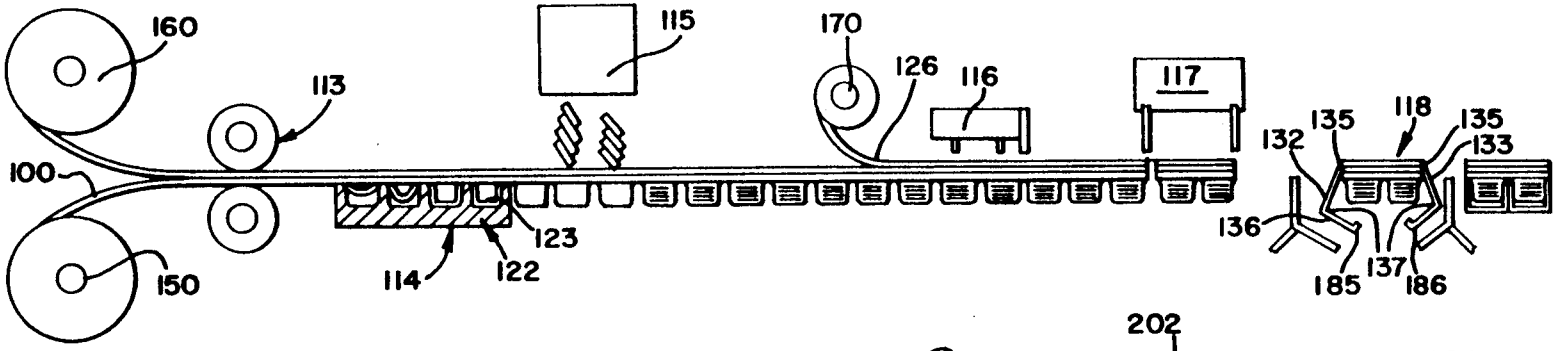
FIG. 8 is a schematic illustration of the packaging system and process used to form, fill and seal the packages of the present invention.

After the film 110 is attached to the package face panel 104, successive package film blanks 108, 108' are advanced to a product tray forming station 114 where the product tray 120, 120' of each package blank 108, 108' is formed from the film 110 (FIG. 5). A mold or platter 122 having an appropriate number of mold cavities corresponding in number and location to match those desired for the final package is brought into contact with the underside of the continuous feed strip 100. A vacuum is applied to the mold as shown in FIG. 5, and the portions of the film 110 positioned over the mold cavities are drawn into the mold cavities 123 to form a continuous strip of interconnected successive package assemblies having product receiving compartments.

A preselected amount of different products, such as meat, dairy products, crackers, and the like are then deposited into the multiple product compartments at a package filling station 115. The filled assemblies are subsequently transferred to a package sealing station 116 where the covering film sheet 126 is fed from a supply roll 170 or the like into a position opposite to and above the multiple product compartments of the package blank assemblies and into contact therewith at the inner and outer rims 140, 141 thereof.

The covering film sheet 126, which may be preprinted, is then adhered to the portions of the product tray 120 which surround the product compartments and is bonded or otherwise suitably affixed thereto at hermetic seal areas 128. The cover film sheet 126 may be bonded to the product tray by any conventional sealing means which will effect the desired hermetic seal such as by heat sealing, adhesive sealing or ultrasonic welding.

Each package blank 108, 108' of the continuous feed strip 100 may have one or more pairs of opposing slits or ports 130, 131 disposed along first marginal fold lines 135, 135' thereof which facilitate the insertion of probes proximate to the product compartments to permit the product compartments to be evacuated and flushed with an anti-oxidant gas, such as nitrogen or carbon dioxide after filling. These slits 130, 131 are disposed in the area of the package face panels 104, 104 which is eventually sealed by the package cover film sheets 126.

The continuous sheet of filled, innerconnected packages are then conveyed to a package separating station 117 where individual package assemblies are separated from the continuous feed strip 100 along the transverse lines 106, 106' thereof. The individual package assemblies are then subsequently conveyed to a final package forming station 118 where the package flap panel (or panels) 132, 133 are folded along first fold lines 135, 135' away from the package face panel 104 (FIG. 7) to form the package side or end panels 136, 136' of the package 10. The flap panels are further folded along second fold lines 137, 137' exterior of the first fold lines 135, 135' to form the bottom package panel 180. As mentioned above, the package sealing flanges 185, 186 are adhered together to complete the package.

It will be seen that while certain embodiments of the present invention have been shown and described, it will be obvious to those skilled in the art that changes and modifications may be made therein without departing from the true spirit of the scope of the invention.

We claim:

1. A method of making a package having a product tray with multiple product compartments which are partially enclosed by sidewalls of the package, comprising the steps of:

providing a package support blank having a package face panel portion and an extended package flap panel portion, the package face panel portion having at least one opening therein which receives a product tray therein having multiple product compartments the package support blank providing a support surface for a formable film;

applying the formable film to the face portion of the support blank such that the formable film covers at least the package face panel opening;

forming multiple product compartments in said formable film to define said product tray by drawing said formable film through said package face panel opening, a portion of said package face panel opening providing the support surface for said formable film during said drawing step and providing a support surface for said product tray after forming, said multiple product compartments occupying substantially all of said package face panel at said opening thereof;

filling said package multiple product compartments with distinct, multiple product portions;

sealing the distinct multiple product portions in said multiple product compartments by covering said multiple product compartments with a flexible film; and forming the extended package flap panel portion around said multiple product compartments to define opposing sidewalls of said package and enclosing a portion of said multiple product compartments between said package outer support blank and said extended package flap panel.

2. The method of claim 1, further including the steps of evacuating said multiple product compartments and gas flushing said multiple product compartments.

3. The method of claim 1, wherein said extended package flap portion includes two package flap panels extending along opposite sides of said support blank, the two package flap panels being assembled around a portion of said product tray multiple product compartments, said package flap panels defining two opposing sidewalls of said package, and portions of said package flap panels being adhered to an interior surface of said face panel portion by adhesive means.

4. The method of claim 1, wherein said package outer support blank has three openings therein and said product tray includes three product compartments.

5. The method of claim 1, wherein said package outer support blank has two package flap portions which extend outwardly from opposite sides of said package blank face portion, said two package flap portions being folded underneath said multiple product compartments and being adhered to each other.

6. The method of claim 1, wherein said product tray outer support blank has seven openings therein and said package includes seven product compartments.

7. A multiple product compartment package made in accordance with the method of claim 1.

8. The method of claim 1, wherein said package face panel at least one opening is disposed within an outer rim of said package support blank and said package face panel portion further includes an inner rim member, said inner rim member and outer rim cooperating to define said at least one package support blank opening and wherein said formable film is adhered to substantially all of said package support portion inner rim member and to a first portion of said package portion outer rim and, said flexible film being adhered to a second portion of said package support portion outer rim.

9. A package having multiple product compartments which are located between two portions of the package comprising, in combination:

a package support component having at least one opening therein, the package support component including an outer rim extending around a portion of the perimeter of said opening the package support component supporting a product tray component having multiple product compartments thereon;

the product tray component having an outer rim extending around a portion of its perimeter, a portion of said product tray component outer rim contacting a portion of said package support component outer rim in a manner such that said multiple product compartments depend downwardly from said package support component into said package support component at least one opening and are supported in place therein by said package support component outer rim portion;

said package support component including at least one package flap portion extending away from said package support component, the package flap portion enclosing a portion of said multiple product compartments between said package support component and said package flap portion, said package flap portion defining two opposing sidewalls and a base sidewall of said package; and, a package cover film portion sealing said multiple product compartments.

10. The package of claim 9, wherein said product tray includes three distinct product compartments.

11. The package of claim 9, wherein said package support component includes three openings and said product tray component includes three product compartments, said package support component further including an inner rim member disposed within said outer rim portion thereof, said package support component inner rim member and outer rim cooperating to define the package support component three openings, said package support component inner rim member and outer rim further supporting said product tray component in place between said package support component and said package flap portion.

12. The package of claim 9, wherein said package support component includes three openings and said product tray component includes three product compartments, each of the openings being defined within said package support component by said outer rim and an inner rim member, each of said openings being adapted to receive a distinct product compartment of said product tray therein said package support component outer rim and inner rim member being adapted to supportingly engage an respective associated inner rim member and outer rim of said product tray, such that said package support component outer and inner rims cooperate to provide a product tray component support surface which substantially surrounds each of the three openings, said package support rim outer and inner members being adhesively engaged to said product tray component outer and inner rim members.

13. The package of claim 9 wherein said product tray includes seven distinct product compartments.

14. The package of claim 9, wherein said product tray is vacuum formed from a sheet of flexible film.

15. The package of claim 9, wherein said product tray is vacuum formed from a sheet of semi-rigid film.

16. The package of claim 9, wherein said package support component includes two opposing package flap panels extending away from said package support portion, the two package flap further including two bottom panels and two engagement panels, the two engagement panels contacting each other and said flap panels and bottom panels cooperating with said package support portion to define said package.

17. The package of claim 9, wherein said package support component includes slit means which permits insertion of gas flushing means therein during assembly of said package, the slit means being sealed by said cover film portion.

18. The package of claim 9, wherein said package support component outer rim includes adhesive means contacting said product tray component outer rim.

19. The package of claim 9, wherein each of said multiple product compartments are gas flushed.

20. The package of claim 9, wherein said package product tray includes three distinct product compartments and each of the three distinct product compartments contains a product chosen from the group consisting of meat products, dairy products, cracker products or a combination thereof.

21. The package of claim 9, wherein said package cover film is hermetically sealed to said product tray.

22. The package of claim 21, wherein the package cover film hermetic seal is a peelable seal.

23. The package of claim 9, wherein said package support component includes two package flap panels disposed on opposite sides of said package support component, said package component having been formed from a blank including two first fold lines separating said package flap panels from a package support portion.

24. The package of claim 23, wherein said two package flap portions include two second fold lines disposed generally parallel to said first fold lines, said first and second fold lines defining package side panels therebetween, said two package flap portions each having a package bottom panel disposed thereon exterior of said second fold lines, said product tray being partially enclosed between said package support portion and the two package bottom panels.

25. A package comprising a product tray having a plurality of hollow product receptacles for containing portions of a product or products in a sealed state therein, adjacent product receptacles being integrally connected by a common connective interior flange, the plurality of product receptacles further having an outer rim flange defining the perimeter of the product tray, said interior flange and outer rim cooperating to define the perimeter of each of said product receptacles, a cover film sealingly attached to said connective interior flange and to said outer rim flange of said product tray thereby to seal the products in said product receptacles, said product tray contacting, along said interior flange and outer rim flange thereof, a support panel having two pairs of generally parallel panel sides, the support panel supporting said product tray and said support panel further having at least one opening therein which receives said product receptacles, said support panel having a pair of package end flap panels extending away from said support panel, the end flap panels including distinct base panels and support panels, the support panels adhesively engaging each other beneath said product tray so as to enclose product containing portions of said product receptacles between said support panel and said base panels, the package cover film being further sealingly attached to said support panel.

26. The package of claim 25, wherein said support panel includes three separate openings, said three openings being separated by a support panel interior connective flange, said three openings being which receive three product receptacles of said product tray, said product tray interior flange being adhesively secured to said support panel interior connective flange and said product tray outer rim being adhesively secured to said support panel outer rim flange.

27. The package of claim 25, wherein said support panel includes seven openings which receive seven hollow receptacles of said product tray.

28. A connected series of package blanks which can be formed into a unitary multiple compartment package having a multiple compartment product tray enclosed in a paperboard package, comprising:

a continuous package forming web having a series of transverse lines of potential severance longitudinally spaced apart on said web to define a series of individual package units, each package unit having a package forming ply which includes a package support panel having at least one opening therein, the package support panel including a support rim extending around said opening, a pair of end flap panels disposed on opposite ends of said package support panel, the end flap panels being folded around a product tray which is held in place within said support panel opening, the end flap panels further having distinct base and support panels, the support panels engaging each other to form a generally rectangular enclosure for the multiple compartments of said product tray, and the package forming web further having a sheet of formable film contacted thereto around the perimeter of said package support panel opening, the formable film sheet being adhered to said package support rim by adhesive means.

29. The structure of claim 28, wherein said package forming ply includes three openings therein.

30. The structure of claim 28, wherein said package forming ply includes seven openings therein.

31. The method of claim 1, wherein said extended flap portion includes two package flap panels extending along opposite sides of said face panel portion, the two package flap panels being assembled around a portion of said product tray which depends downwardly through said package face panel portion opening, said two package flap panels being adhered together by adhesive means beneath said package face panel portion.

* * * * *